United States Patent [19]

Crawford et al.

[11] Patent Number: 4,747,428

[45] Date of Patent: May 31, 1988

[54] FAUCET NUT HAVING AN INTEGRAL FLARED FLANGE

[75] Inventors: Dennis W. Crawford, Pontiac; Larry G. Turner, Clarkston, both of Mich.

[73] Assignee: Masco Corporation of Indiana, Indianapolis, Ind.

[21] Appl. No.: 92,301

[22] Filed: Sep. 2, 1987

[51] Int. Cl.[4] ..... F16K 43/00; F16K 11/08

[52] U.S. Cl. ..... 137/315; 137/359; 137/606; 137/801

[58] Field of Search ..... 137/315, 359, 454.2, 137/454.5, 454.6, 606, 801

[56] References Cited

U.S. PATENT DOCUMENTS

| | | | |
|---|---|---|---|
| Re. 30,559 | 10/1987 | Schmitt | 137/315 |
| 2,089,848 | 8/1937 | Hoferle | 137/315 |
| 2,591,991 | 4/1952 | Young | 137/606 |
| 3,003,519 | 10/1961 | Homeyer et al. | 137/454.6 |
| 3,229,710 | 1/1966 | Keller | 137/606 |
| 3,448,768 | 6/1969 | Keller | 137/606 |
| 3,780,758 | 12/1973 | De Vries | 137/454.6 |
| 3,789,862 | 2/1974 | Keller | 137/606 |
| 3,789,870 | 2/1974 | Keller | 137/454.5 |
| 3,814,120 | 6/1974 | Moen | 137/606 |
| 4,058,289 | 11/1977 | Hicks | 137/606 |
| 4,077,426 | 3/1978 | Karie | 137/454.6 |
| 4,331,176 | 5/1982 | Parkison | 137/454.6 |
| 4,606,372 | 8/1986 | Hayman | 137/315 |
| 4,607,659 | 8/1986 | Cole | 137/454.6 |
| 4,700,736 | 10/1987 | Sheen | 137/454.6 |
| 4,700,928 | 10/1987 | Marty | 137/454.6 |

FOREIGN PATENT DOCUMENTS

| | | | |
|---|---|---|---|
| 16791 | 1/1972 | Australia | 137/315 |
| 2231702 | 1/1973 | Fed. Rep. of Germany | 137/606 |

OTHER PUBLICATIONS

"Space Shuttle Engines Use Longer-Life Fasteners", *Design News*, Jan. 1984.

Cornell Spiralock Locknuts, Cornell Manufacturing Co., Inc., Advertising Brochure.

Thomas Register 1985, Entries for Self-Locking Nuts, pp. NUT/10944-NUT/10947.

*Primary Examiner*—George L. Walton

*Attorney, Agent, or Firm*—Edgar A. Zarins; Steven L. Permut; Malcolm L. Sutherland

[57] ABSTRACT

A retaining nut for a faucet assembly which serves the dual purpose of mounting the valve body to the faucet housing while also retaining the valving member within the valve body. The nut is preferably made of plastic and includes a resilient annular flange which cooperates with the faucet housing to seal the periphery of the valve body. The resilient properties of the annular flange maintain engagement despite movement and separation during use of the faucet and initial manufacturing tolerances. The outer surface of the faucet nut includes a series of ribs to facilitate manual removal in addition to the hexagonal configuration for removal using an appropriate hand tool.

17 Claims, 1 Drawing Sheet

FIG. 1.
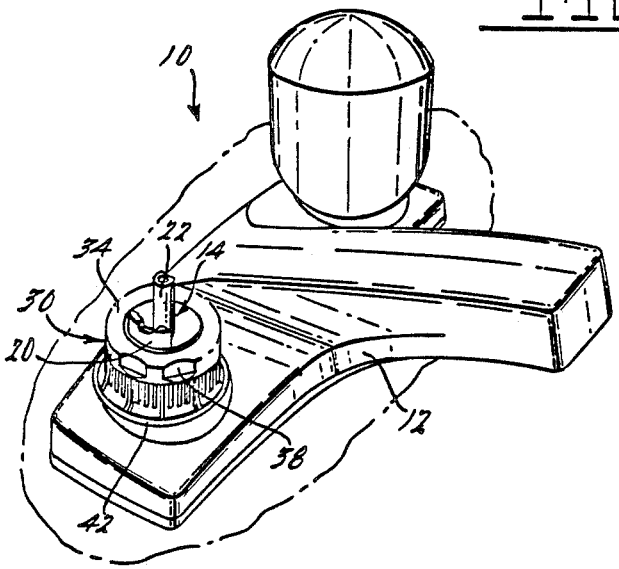
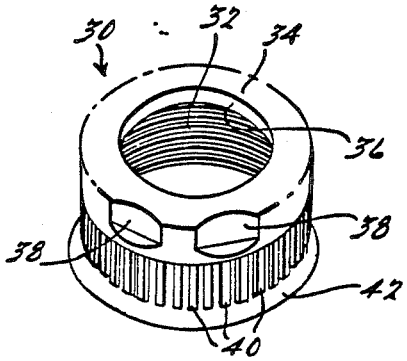
FIG. 2.
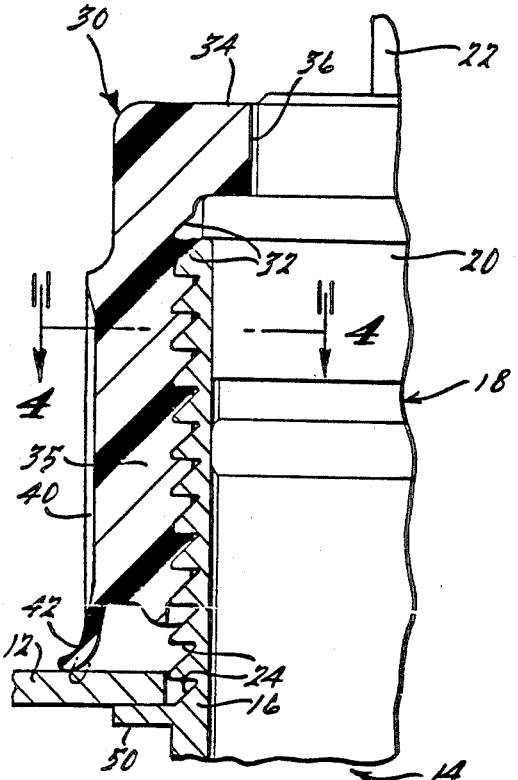
FIG. 3.
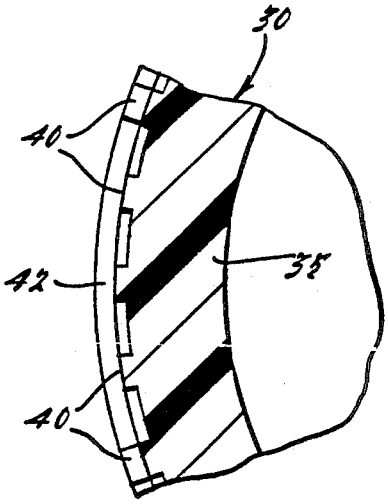
FIG. 4.

FAUCET NUT HAVING AN INTEGRAL FLARED FLANGE

BACKGROUND OF THE INVENTION

I. Field of the Invention

This invention relates to retaining nuts to mount a faucet valve assembly to a faucet housing and, in particular, to a retaining nut with an integral flange which in addition to securing the valve body to the faucet body secures the rotatable valving member within the valve body.

II. Description of the Prior Art

During installation of a faucet assembly various retaining nuts are utilized to secure the components of the faucet within the faucet housing. In conventional faucet assemblies, a first nut is utilized to secure the valve body, which receives the faucet valve cartridge, to the faucet shell while also securing the two halves of the faucet shell. This nut engages the outer threaded portion of the valve body and screws down to positionally capture the faucet body between the nut and a lower flange formed on the valve body. A second nut is thereafter utilized similar to a bonnet to secure the rotatable valving member within the valve body. This second nut includes an upper annular flange which engages the top of the valve member to secure it within the valve body while permitting the valve stem and stop member to extend through the top thereof for rotation.

Normally, both of these retaining nuts are made of metal to provide material strength and use conventional helical thread forms to provide standard engagement. However, in addition to substantially increasing manufacturing and assembly costs by utilizing two metal retaining nuts, the metal to metal engagement of the nuts does not provide any sealing capability to prevent leakage, damage, and/or an increase in spacial tolerances over prolonged use of the faucet. Moreover, with the improvement in plastic materials and their increased use in faucet assemblies, it is advantageous to manufacture as many of the components thereof of plastic materials.

SUMMARY OF THE PRESENT INVENTION

The present invention overcomes the disadvantages of the past known faucet assemblies by providing an integral retaining nut for securing both the valve body and the valving member to the faucet body.

The nut of the present invention is utilized in a faucet assembly generally comprising a faucet body adapted to receive at least one valve body for controlling the fluid flow through the faucet. The valve body, in turn, receives a valving member and stop member, the stop member cooperating with the operating handle to limit rotation of the valving member within the valve body. The valving member includes a valve stem which extends through the stop member and attaches to the operating handle. In order to secure the valve body to the faucet body and to secure the valving member within the valve body, an integral retaining nut threadably attaches to the valve body to engage both the faucet body and the valving member.

The retaining nut embodying the present invention is preferably made of plastic and includes a lower annular flange adapted to resiliently engage the faucet body and an upper annular flange adapted to engage and retain the top of the valving member. The nut is adapted to replace the two nuts normally utilized in faucet assemblies and compensates for manufacturing tolerances in order to securely engage the valving member and the faucet body by providing a resilient annular flange. In a first embodiment, the resilient flange is formed at the bottom of the retaining nut to engage the faucet body. Alternatively, the resilient flange may be formed in conjunction with the upper inwardly disposed flange to resiliently engage the top of the valving member. In either case, the retaining nut ensures secure engagement of both the faucet body and the valving member. Thus, the present invention provides an efficient means of assembling the faucet thereby eliminating duplicity of components and substantially reducing manufacturing and assembly costs.

Other objects, features and advantages of the invention will be apparent from the following detailed description taken in conjunction with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the view and in which:

FIG. 1 is an elevated perspective of a faucet assembly with the retaining nut embodying the present invention attached thereto;

FIG. 2 is an elevated perspective of the retaining nut of the present invention;

FIG. 3 is a partial cross-sectional perspective of the retaining nut of the present invention in conjunction with a faucet assembly; and FIG. 4 is a partial cross-sectional view of the retaining nut taken along line 4—4 of FIG. 3.

DETAILED DESCRIPTION OF A PREFERRED EMBODIMENT OF THE PRESENT INVENTION

Referring first to FIGS. 1 and 2, there is shown a faucet assembly 10 incorporating the faucet nut 30 embodying the present invention. The faucet assembly 10 generally comprises a faucet body or escutcheon 12 and at least one valving assembly 14 for controlling the fluid flow through the faucet 10. Generally, the valving assembly 14 includes a valve body 16 secured within the faucet body 12 and a rotatable valving member 18 seated within the valve body 16 to control the water flow. The valving member 18 may include a stop member 20 and a valve stem 22 which extend through the top end of the valve body 16. The valve body 16 includes external threads 24 to facilitate assembly of the faucet 10. The retaining nut 30 of the present invention is adapted to perform the dual function of maintaining the valving member 18 within the valve body 16 while also securing the faucet body 12 to the valve body as will be described in greater detail herein.

The retaining nut 30 has a substantially tubular configuration with internal thread forms 32 adapted to threadably cooperate with threads 24 on the valve body 16 in order to secure the nut 30 thereto. As shown in FIG. 3, the threads 32 are formed as a buttress thread form to ensure secure engagement between the nut 30 and the valve body 16. Although the thread forms 24 on most past known valve bodies 16 is of a standard "V" configuration, the valve body 16 of the present invention is also provided with a buttress thread form 24 to facilitate engagement. However, by varying the thread pitch and root diameter of the threads 24, the valve body 16 can be utilized with the metal nut of the past known faucet assemblies, which has a standard thread form. The preferred embodiment of the present invention is made of a plastic material to provide a sealing engagement. The plastic construction of the nut 30 also substantially reduces manufacturing costs for the faucet assembly 10.

Referring now to FIGS. 1 through 4, formed at the upper end of the nut 30 is an inwardly disposed annular flange 34. The flange 34 is formed substantially at a right angle to the cylindrical side walls 35 of the nut 30 and forms an annular opening 36 in the top of the nut 30 through which the valve stem 22 and stop member 20 extend as shown in FIGS. 1 and 3. The upper end of the retaining nut 30 is also provided with a hexagonal outer periphery 38 such that the nut 30 can be secured to the valve body 16 using a conventional hand tool such as a wrench.

Formed on the outer periphery of the side wall 35 are a plurality of circumferentially spaced reinforcement ribs 40. The ribs 40 extend longitudinally from just below the hexagonal periphery 38 and meld into the lower end of the nut 30. Because of the plastic construction of the nut 30, the ribs 40 provide structural reinforcement to the side wall 35 while also simplifying molding of the nut 30 by reducing warping and allowing removal from the mold. Moreover, the ribs 40 provide a convenient means of grasping the nut 30 for manual attachment of the nut 30.

Referring still to FIGS. 1–4, formed at the lower end of the nut 30 is a resilient annular skirt or flange 42. Preferably, the resilient flange 42 has an outward curvature as best seen in FIG. 3 although the flange 42 may have any configuration or disposition which allows the flange 42 to resiliently engage the faucet body 12 as the upper annular flange 34 engages the valving member 18. In a still further embodiment of the present invention, the resilient flange 42 may be associated with the upper end of the nut 30 such that the flange 42 resiliently engages the valving member 18 as the lower end of the nut 30 engages the faucet body 12. In either embodiment, the resilient flange 42 is adapted to compensate for manufacturing tolerances in the length of the valve body 16 above the faucet escutcheon 12 thereby ensuring complete and secure engagement between the nut 30 and both the valving member 18 and faucet body 12. In addition, as shown in FIGS. 3 and 4, at least one of the reinforcement ribs 40 may extend onto the resilient flange 42 to provide added strength to the flange 42. The number and spacing of the ribs 40 which extend onto the flange 42 can be varied in accordance with the desired resiliency or flexibility of the flange 42. In one embodiment of the present invention, the resilient flange 42 has an outward curvature with approximately every fourth rib 40 extending onto the flange 42.

As has been noted and is best shown in FIGS. 1 and 3, the faucet nut 30 of the present invention replaces the two separate nuts found on past known faucet assemblies to engage and secure the valving member 18 within the valve body 16 and the faucet escutcheon 12 to the valve body 16. After assembling the faucet body 12 and inserting the valving member 18 within the valve body 16, the retaining nut 30 may be mounted to the valve body 16. As the nut 30 is rotated to engage the threads 32 with the threads 24, the nut 30 will travel down the valve body 16. Initially, the resilient flange 42 will engage the faucet body 12 and be forced outwardly as shown in FIG. 3. The nut 30 will continue to travel downward and the flange 42 will bend outwardly until the upper flange 34 engages the top of the valving member 18 to secure it within the valve body 16. In this manner, manufacturing tolerances are compensated for by the resiliency of the flange 42 which ensures securement of the valving member 18 within the valve body 12 and to eliminate any give or play between the valve body 16 and the faucet escutcheon 12. To ensure proper engagement of the faucet body 12, a secondary flange or nut 50 may be secured to the valve body 16 beneath the faucet escutcheon 12 such that the body 12 is captured between the flange 50 and the faucet nut 30. The nut 30 may be mounted to the valve body 16 either manually by grasping the ribs 40 and side wall 35, or with a wrench using the hexagonal periphery 38.

Thus, the present invention provides a substantial reduction in manufacturing and assembly costs for faucets by replacing the two nut system of conventional faucet assemblies with a single integral faucet nut. The use of the single integral nut eliminates the necessity of tooling for two different nuts while also eliminating an assembly operation. Moreover, the plastic construction of the faucet nut is substantially less expensive than the two metal nuts normally utilized. Finally, it is this plastic construction and, in particular, the resiliency of the lower flange which allows the faucet nut of the present invention to compensate for manufacturing tolerances and thereby ensure engagement with both the valving member and the faucet escutcheon using an integral faucet nut.

The foregoing detailed description has been given for clearness of understanding only and no unnecessary limitations should be understood therefrom as some modifications will be obvious to those skilled in the art without departing from the scope and spirit of the appended claims.

We claim:

1. In a faucet assembly including a faucet body, at least one valve body disposed within the faucet body, and a valving member adapted to be rotatably seated within the valve body, the improvement comprising:

an integral retaining nut having an annular resilient flange integrally formed therewith for securing the faucet body to the valve body ad positionally maintaining the valving member within the valve body.

2. The faucet assembly as defined in claim 1 wherein said retaining nut comprises an annular flange formed at an upper end of said nut, said flange being inwardly disposed and adapted to engage the valving member within the valve body such that the valving member valve stem extends upwardly through said annular upper flange of said retaining nut.

3. The faucet assembly as defined in claim 1 wherein said resilient flange is integrally formed at a lower end of said nut and wherein said resilient flange is flared outwardly to resiliently engage the faucet body.

4. The faucet assembly as defined in claim 3, wherein said retaining nut includes a plurality of circumferentially spaced ribs formed on the outer periphery of said retaining nut.

5. The faucet assembly as defined in claim 4 wherein at least one of said ribs extends onto said resilient flange to provide structural strength to said resilient flange.

6. The faucet assembly as defined in claim 5 wherein said integral retaining nut is made of a plastic material.

7. The faucet assembly as defined in claim 1 wherein said retaining nut includes internal threads adapted to threadably engage the valve body.

8. In a faucet assembly including a faucet body, at least one externally threaded valve body disposed within the faucet body, and a rotatably valving member having a valve stem seated within the valve body, the improvement comprising:

an integral retaining nut for securing the faucet body to the valve body and positionally maintaining the rotatable valving member within the valve body, said nut threadably engaging the valve body;

wherein said retaining nut comprises an inwardly extending annular flange formed at an upper end of said nut and a resilient annular flange formed at a lower end of said nut whereby upon attaching said nut to the valve body said upper annular flange engages the top of the valving member to secure the valving member within the valve body with the valve stem thereof extending through said upper annular flange and said lower annular flange resiliently secures the faucet body against the valve body.

9. The faucet assembly as defined in claim 8 wherein said integral retaining nut is made of a plastic material.

10. The faucet assembly as defined in claim 9 wherein said resilient flange is flared outwardly.

11. The faucet assembly as defined in claim 10 wherein said nut further comprises a plurality of circumferentially spaced reinforcement ribs formed on the outer periphery thereof, at least one of said ribs extending onto said flared resilient flange.

12. A retaining nut for a faucet assembly having a faucet body, at least one valve body disposed within the faucet body, and a rotatable valving member seated within the valve body, said retaining nut comprising:

a substantially tubular body having an inwardly extending annular flange formed at the upper end of said tubular body and an integral resilient flange formed at the lower end of said tubular body;

wherein said upper annular flange engages the valving member to maintain the valving member within the valve body and said resilient flange engages the faucet body to secure the faucet body to the valve body.

13. The retaining nut as defined in claim 12 wherein said resilient flange is flared annularly outwardly from the lower end of said tubular body.

14. The retaining nut as defined in claim 13 and further comprising a plurality of circumferentially spaced reinforcement ribs formed on the outer periphery of said tubular body.

15. The retaining nut as defined in claim 14 wherein at least one of said ribs entends onto said flared flange to provide structural strength to said resilient flange.

16. The retaining nut as defined in claim 15 wherein said retaining nut is integrally formed of a plastic material.

17. The retaining nut as defined in claim 12 wherein said tubular body includes a plurality of thread forms on the inner periphery thereof whereby said retaining nut threadably engages the valve body to secure the valving member and the faucet body.

* * * * *